United States Patent [19]

Nowak et al.

[11] Patent Number: 4,624,475

[45] **Date of Patent: * Nov. 25, 1986**

[54] RELEASE SKI BINDING

[75] Inventors: Gerhard Nowak, Biedermannsdorf; Alfred Winter; Hans P. Morbitzer, both of Vienna; Klaus Kruschik, Gumpoldskirchen, all of Austria

[73] Assignee: TMC Corporation, Baar, Switzerland

[ * ] Notice: The portion of the term of this patent subsequent to Apr. 29, 2003 has been disclaimed.

[21] Appl. No.: 572,099

[22] Filed: Jan. 19, 1984

[30] Foreign Application Priority Data

Jan. 21, 1983 [AT] Austria ..... 192/83

[51] Int. Cl.[4] ..... A63C 9/081

[52] U.S. Cl. ..... 280/618; 280/624

[58] Field of Search ..... 280/618, 616, 617, 624, 280/634, 636, 613, 620

[56] References Cited

U.S. PATENT DOCUMENTS

| | | | |
|---|---|---|---|
| 3,529,844 | 9/1970 | Salomon | 280/634 |
| 3,830,510 | 8/1974 | Stauffer | 280/634 |
| 4,145,071 | 3/1979 | Salomon | 280/624 |
| 4,239,254 | 12/1980 | Riedel | 280/605 |
| 4,312,517 | 1/1982 | Spademan | 280/624 |
| 4,352,508 | 10/1982 | Spademan | 280/634 |
| 4,394,032 | 7/1983 | Storandtz et al. | 280/618 |
| 4,489,956 | 12/1984 | Jungkind | 280/632 |
| 4,573,701 | 3/1986 | Nowak et al. | 280/616 |

FOREIGN PATENT DOCUMENTS

| | | | |
|---|---|---|---|
| 2156334 | 5/1973 | Fed. Rep. of Germany | 280/616 |
| 2324078 | 11/1974 | Fed. Rep. of Germany | 280/618 |
| 2533337 | 5/1976 | Fed. Rep. of Germany | 280/618 |
| 2943209 | 10/1979 | Fed. Rep. of Germany | 280/624 |
| 3026918 | 7/1980 | Fed. Rep. of Germany | 280/624 |
| 2293226 | 2/1976 | France | 280/624 |

*Primary Examiner*—John J. Love
*Assistant Examiner*—Eric D. Culbreth
*Attorney, Agent, or Firm*—Flynn, Thiel, Boutell & Tanis

[57] ABSTRACT

A release ski binding having a sole plate which in its center area can be pivoted about an approximately vertical axis and can be tilted up about a transverse axis arranged in front of the vertical axis, which in the skiing position is held on the ski by a holding mechanism biased by a release spring, which holding mechanism is responsive to a swivelling movement of the sole plate relative to the ski and upon reaching a predetermined angle of traverse effects both an upwardly and also a side opening of a locking mechanism.

18 Claims, 8 Drawing Figures

RELEASE SKI BINDING

FIELD OF THE INVENTION

This invention relates to a ski binding which engages the middle part of a ski boot and, more particularly, to a ski binding incorporating therein a sole plate movable elastically of the ski until a release condition is exceeded.

BACKGROUND OF THE INVENTION

Such release ski bindings are described in German Pat. No. 2 533 337. In these conventional ski bindings, the spring of the holding mechanism acts through a piston onto an approximately mushroom-shaped follower member, which is supported swingably to all sides in the housing of the holding mechanism. The stem portion of the mushroom-shaped follower member is received in a recess of a ski-fixed fitting. In these known ski bindings, the ski shoe is held at its tip or toe by means of a rigid bar on the sole plate. In the case of a fall of the skier to the rear, the ski shoe is therefore released only with great difficulty.

This disadvantage is avoided in the ski binding according to German Pat. No. 2 324 078, however, this binding is very complicated in its design. That is, the release mechanism is housed in the space between the base plate and the sole plate. This, however, requires special seal structure to prevent the penetration of snow and dirt therein. Furthermore, the mounting is complicated and expensive.

The goal of the invention is to overcome the disadvantages of the conventional designs and to provide a release ski binding of the above-mentioned type, which is simple in its design and permits a very exact adjustment of the desired release moment during a frontal fall and during a twisting fall.

This goal is inventively attained primarily by providing a locking mechanism having two clamping jaw pairs which laterally engage the ski shoe and which are constructed as two-arm levers, are supported on the sole plate and can be moved into the clamping position by a slide-member plate which is guided on the sole plate and is provided with wedge-shaped shoulders, whereby the slide-member plate is coupled by means of a control lever having a stepping bar which is supported on the sole plate.

The concept of supporting one-arm clamping jaws, which laterally engage the ski shoe, on a sole plate and to move same through a slide-member plate with the help of wedge-shaped shoulders into the clamping position is actually already known through the teachings in German OS Nos. 2 943 209 and 3 026 918. However, in these constructions, the locking spring acts directly onto the clamping jaws, the load of which is utilized for the involuntary or automatic release of the ski binding, and brings about certain inexactnesses compared with the ski bindings of the above-mentioned type in which the angle of traverse of the sole plate is decisive for effecting the opening of the locking mechanism.

Furthermore, it is no longer new to use stepping bars in ski bindings (compare U.S. Pat. No. 4,312,517). However, in the known ski binding the stepping bar is only used to swing during a stepping in procedure wherein the ski shoe effects a movement of the two braking mandrels from their braking position upwardly over the plane of the upper surface of the ski and at the same time to align the ski shoe both in the longitudinal direction and also in the transverse direction of the ski. An operation of the holding elements for the ski shoe by action of the stepping bar does not take place in this construction.

Furthermore, the invention provides that the axle for the stepping bar is arranged in the end region of the sole plate, closest the tip of the ski. This causes the stepping of the ski shoe into the ski binding to be simplified inasmuch as the relative movement between the tip of the ski shoe and the ski, compared with the reversed arrangement (arrangement of the stepping bar axle on the end of the sole plate remote from the tip of the ski), is substantially reduced.

Furthermore, the control lever is inventively constructed as a two-arm lever supported on the sole plate and the upper end of which is guided by means of a roller in guideways provided on the underside of the stepping bar. This enables a large amount of leverage to be achieved and with it the force, which is necessary for the adjustment of the slide-member plate, can be substantially reduced.

According to another characteristic of the invention, the lever arm of the control lever, which lever arm lies opposite the roller, is constructed fork-shaped and is provided with two inner prongs and two outer prongs. Through this construction the function which is to be carried out by the control lever is divided into two pairs of elements, whereby the one pair is to cause only the movement of the slide-member plate toward the tip end of the ski, the other pair, however, causing first an adjustment of the slide-member plate toward the tip of the ski and thereafter a sudden movement of the slide-member plate rearwardly into the clamping position.

In order to make the opening of the ski binding easier, two bearing blocks are inventively secured to the upper surface of the slide-member plate, in which bearing blocks a bolt is movably guided in the longitudinal direction of the ski, which bolt is under the influence of a spring urging it toward the tail end of the ski. A further characteristic of the invention is to provide the control lever with a nose at its end which carries the roller, which nose serves as a load bearing place against which the bolt rests in the skiing position of the ski binding.

Of course it would be possible to provide the slide-member plate with shoulders for the engagement of the two prong pairs. However, it is preferable that the slide-member plate be provided with a hole located between the bearing blocks, which hole is preferably approximately T-shaped in the top view, into which hole, in the stepping-in position of the ski binding, is received the four prongs of the control lever.

Furthermore, it is provided inventively, that the slide-member plate is releasably connected to the resilient holding mechanism through at least one one-arm locking lever, which holding mechanism, is housed in a housing on the sole plate. According to this characteristic, a retaining spring is utilized for loading the slide-member plate. The spring thus has to fulfill two functions simultaneously. This brings about a certain simplification of the construction. It is thereby preferable for the slide-member plate to be constructed fork-shaped at its end which is adjacent to the holding mechanism and supports a roller thereon on each forked prong. The roller, in the skiing position of the ski binding, rests on a shoulder of the associated locking lever, which shoulder extends transversely with respect to the longitudinal axis of the ski. The two rollers substantially increase the exactness with which the ski binding opens during the adjusted release moment, since the friction between the slide-member plate and the two locking levers is substantially reduced by the rollers.

In a ski binding wherein the holding mechanism includes a mushroom-shaped follower member, the enlarged head of the follower member is supported swingably to all sides in a hole in a wall of the sole plate. The follower member is held in the normal position under the influence of a piston which is loaded on one side thereof by the release spring and with its stem received in a ski-fixed fitting. A bolt or pin extends through the piston, the ends of which bolt are guided in slotted holes in the wall of the sole plate. The legs of an approximately U-shaped intermediate lever, is supported in the housing on the sole plate and engage under the influence of a torsion spring the ends of the bolt. The ends of the bolt project laterally beyond the slotted holes in the wall and operatively engage each leg of the intermediate lever. A reliable coupling of piston and locking lever is brought about in this manner. This effect is also desired by a further characteristic of the invention, namely, that for coupling of the intermediate lever with each locking lever, the first supports an axle thereon, which axle is guided in a slotted hole which extends in the longitudinal direction of the locking lever.

In order to facilitate a manual release of the ski binding in a simple manner, the invention includes the provision that at least one link member has one end arranged on the axle and the other end hingedly connected to a two-arm release lever which is supported on the housing of the sole plate.

Also a direct loading of the piston associated with the follower member by the spring of the holding mechanism would principally be conceivable. However, in order to permit a very sensitive adjustment of the initial spring tension, a one-arm lever is inventively supported on the axis for the intermediate lever, which one-arm lever rests with a cam on the piston in the hole of the sole plate and on the oppositely lying side is loaded by the spring of the holding mechanism. It is thereby preferable, if the release spring is housed in a spring housing which is pivotal about the axis of the axle for the locking lever so that the axle is movable approximately in the longitudinal direction of the ski in at least one slotted hole in the housing. Furthermore, it is provided that in the center area of the spring housing, bearing pins are connected thereon, on which bearing pins are supported two laterally spaced two-arm levers, the lower ends of which are connected through a rotatably supported bolt and the upper ends of which are supported on a support wall in the housing, which support wall extends at least approximately parallel with respect to the upper surface of the ski. The bolt has a threaded hole therein which extends transversely with respect to the bolt axis, into which threaded hole is threadedly engaged an adjusting screw, the end of which is supported for example by means of a flange on the inner side of the spring housing. This development makes it possible to maintain constant the relationship of the initial tension of the locking spring at the start of the elastic range and at the release point even when the initial tension of the locking spring which is active at the start of the elastic range is changed by means of the adjusting screw.

In order to also permit in the region of the spring housing a transfer of the spring force without large friction losses, a piston, which is loaded by the release spring, is guided in the spring housing, which piston has a roller on the side thereof remote from the release spring. The roller is adapted to rest on the lever.

Finally, it has been proven to be particularly preferable for the manufacture of the ski binding, if the slide-member plate consists of at least two plate-shaped parts, which receive the wedge-shaped shoulders therebetween them and are connected to one another by plural rivets or the like.

BRIEF DESCRIPTION OF THE DRAWINGS

One exemplary embodiment of an inventive ski binding is illustrated in the drawings, in which.

DETAILED DESCRIPTION

Figure 6:
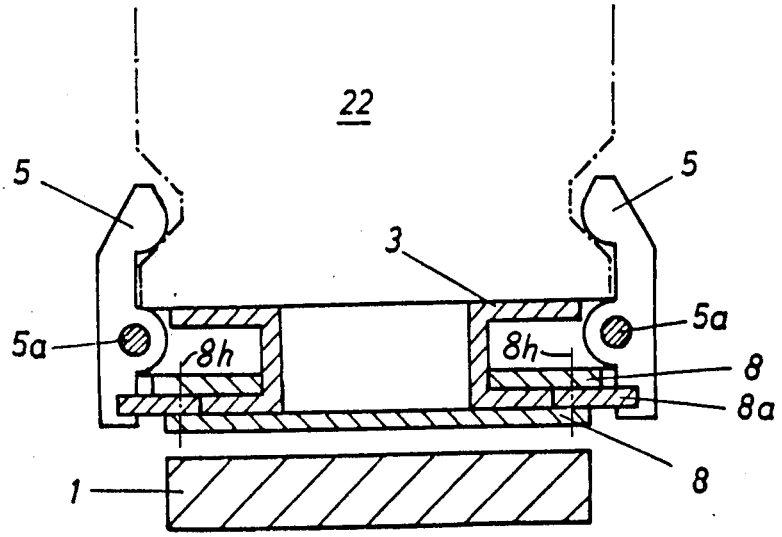
FIG. 6 is a cross-sectional view taken along the line VI—VI of FIG. 2.

Three holding elements are secured to the upper surface of a ski 1, namely a down-holding means 1*a*, a center bearing pin 1*b* and a bearing block 1*c* for a follower member 2. A sole plate 3 is provided above the ski 1 and has at its front end a transversely extending upper support bar 3*a*, a lower support part 3*b* spaced rearwardly therefrom and which extends parallel to the upper support bar, a downwardly opening receiving hole 3*c* adapted to receive therein the bearing pin 1*b*, and a housing 3*d* in which is housed a holding mechanism 4. Two pairs of clamping jaws 5 are pivotally supported on the side surfaces of the sole plate 3 and about longitudinally extending axes 5*a* (see FIG. 6). Each clamping jaw 5 is constructed as a two-arm lever.

Figure 8:
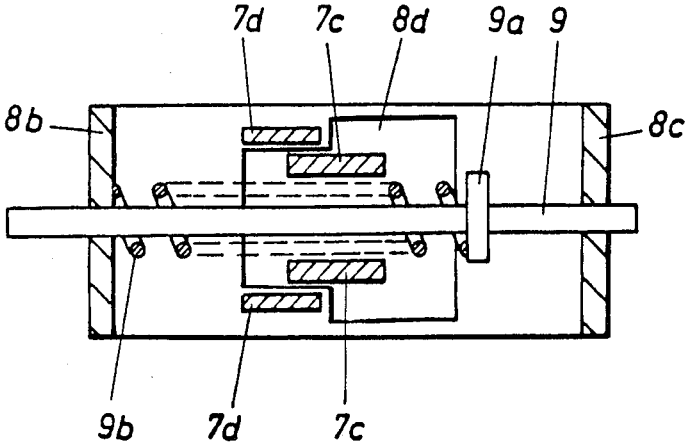
FIG. 8 is a cross-sectional view taken along the line VIII—VIII of FIG. 7.

A stepping bar 6 is pivotally supported for movement about a horizontally extending axle 6*a* in the sole plate 3. The stepping bar 6 is responsive to an erecting spring 6*b* which, in this embodiment, is constructed as a torsion spring. In addition, the stepping bar 6 has on its underside a longitudinally extending guideway 6*c* and in which is guided a roller 7*a* which is supported at the end of a control lever 7. The end of the control lever 7 has a nose 7*e* thereon. The control lever 7 is constructed as a two-arm lever and can be pivoted about an axle 7*b* which is supported on the sole plate 3. The end of the lever arm remote from the roller 7*a* has plural prongs thereon, namely, it has two longer inner prongs 7*c* and two shorter outer prongs 7*d* (see FIG. 8), the purpose of which will be discussed hereinbelow.

Figure 7:
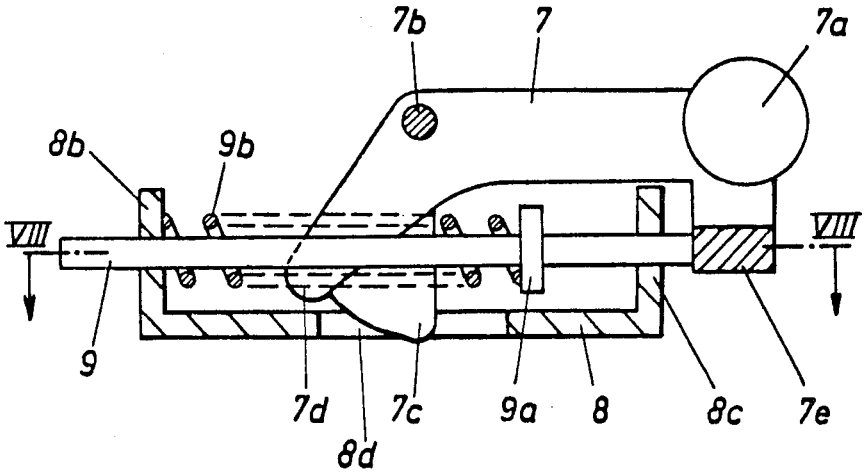
FIG. 7 is an enlarged longitudinal cross-sectional view of a detail of the ski binding.

A slide-member plate 8 is movably guided on the sole plate 3. The slide-member plate 8 has, viewed from the top, wedge-shaped shoulders 8*a*, which act onto the lower arms of the clamping jaws 5 when in the clamping position of the ski binding. According to FIG. 6, the slide-member plate 8 consists of two parts, one on top of the other and between which is provided the shoulders 8*a*. The two parts are connected by rivets schematically shown as at 8*h* in FIG. 6. Two bearing blocks 8*b* and 8*c* are secured to the slide-member plate 8, in which bearing blocks is movably guided in the longitudinal direction of the ski, an elongate rod 9. The rod 9 has a flange or collar 9*a* thereon against which engages one end of a pressure spring 9*b*, the other end of which engages the bearing block 8*b* (see FIG. 7). The spring 9*b* urges the rod 9 toward the tail end of the ski. A hole 8*d*, which is approximately T-shaped, when viewed from the top (see FIG. 8), is provided in the slide-member plate 8, into which hole, in the stepping-in position of the ski binding, extend the inner prongs 7*c* and the outer prongs 7*d*. If the stepping bar 6 is stepped down upon by the foot of the user, then the outer prongs 7*d* become supported on the two shoulders of the approximately T-shaped hole, which shoulders are provided laterally adjacent the stem portion of the T-shaped hole 8*d*, whereas the inner prongs 7*c* can swing unhindered into the cross portion of the hole 8*d*. The prongs 7*c* are designated only for engaging the right boundary or edge of the hole 8*d* illustrated in FIG. 8.

Figure 2:
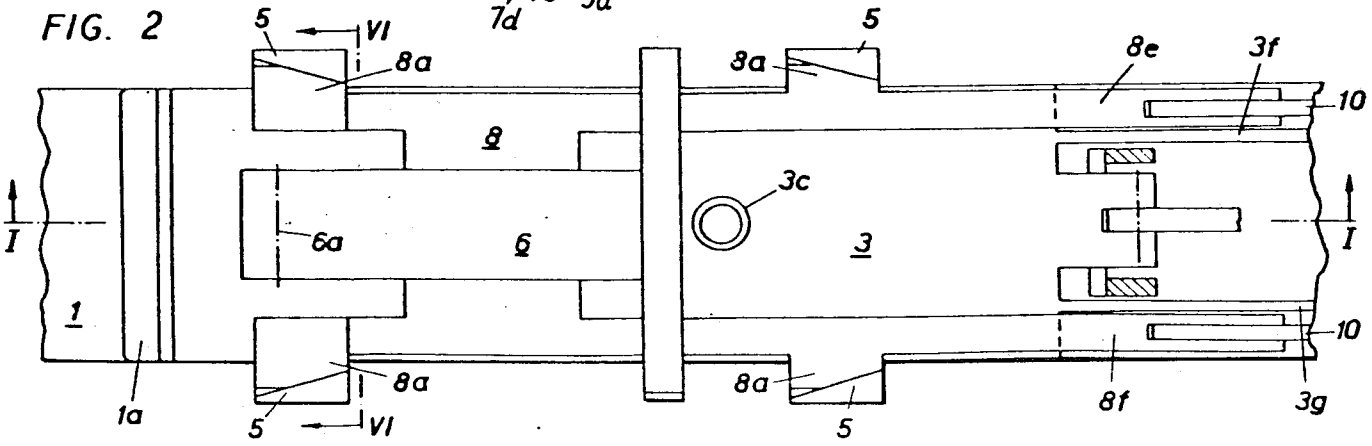
FIG. 2 is a top view of the ski binding with the stepping bar stepped down upon.
Figure 3:
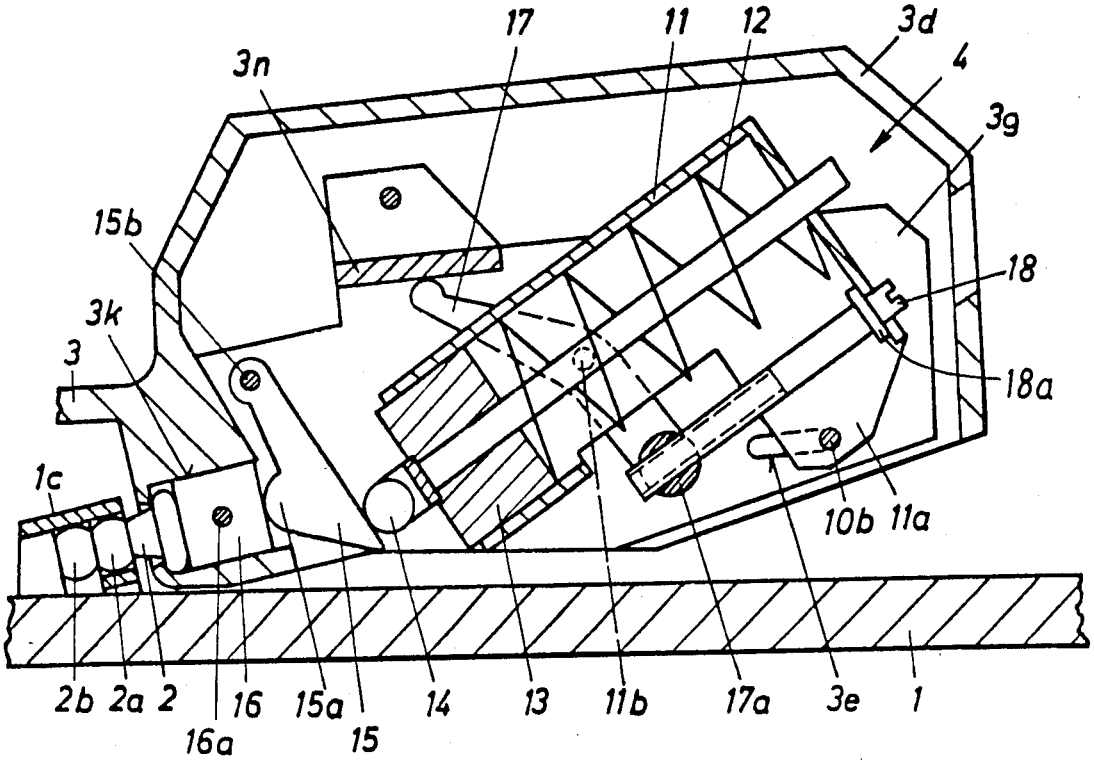
FIG. 3 is a cross-sectional view of the holding mechanism taken along the line III—III of FIG. 5.
Figure 4:
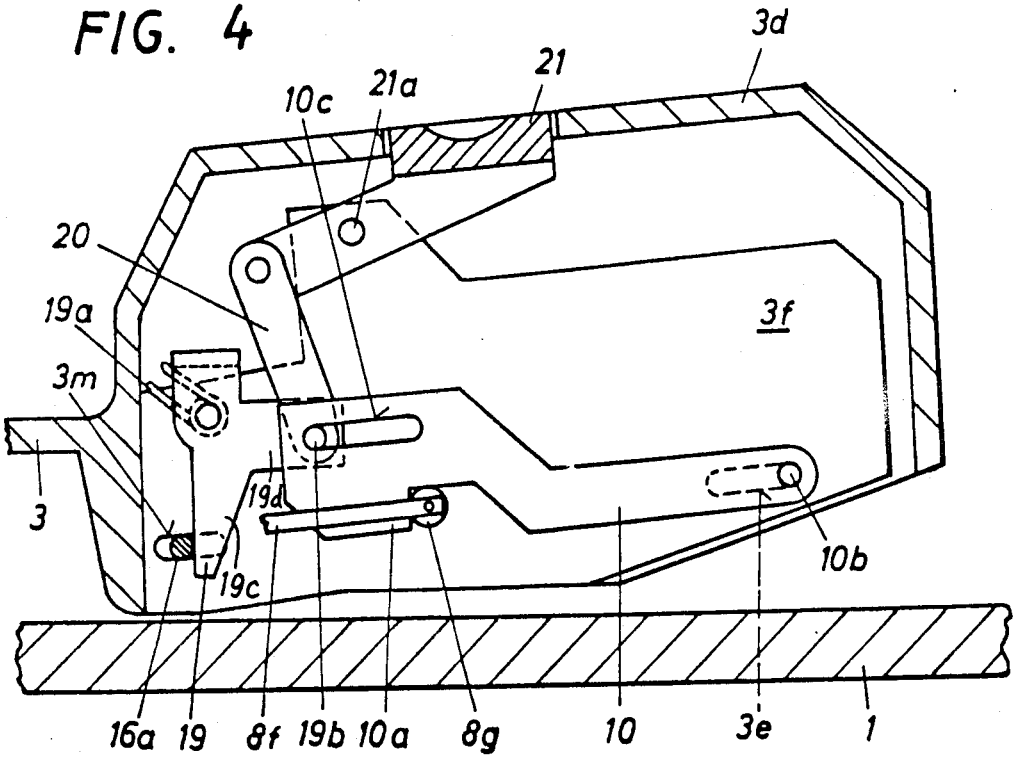
FIG. 4 is a cross-sectional view of the holding mechanism taken along the line IV—IV of FIG. 5.
Figure 5:
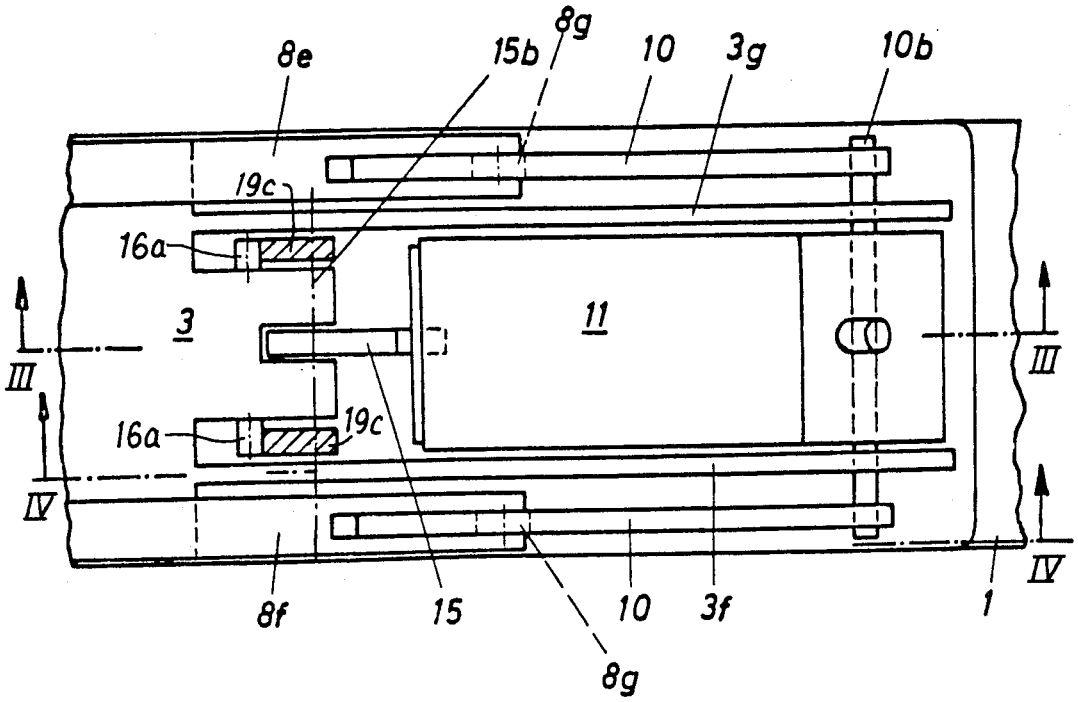
FIG. 5 is a top view of the holding mechanism with the housing lid removed.

The slide-member plate 8 is constructed fork-shaped at the end thereof remote from the clamping jaws 5, namely, adjacent the holding mechanism 4. That is, the plate 8 has a pair of rearwardly extending bifurcated prongs 8*e* and 8*f*. Each bifurcated prong 8*e* and 8*f* has a roller 8*g* thereon, which in the skiing position of the ski binding engages a shoulder 10*a* on a one-arm locking lever 10. Each locking lever 10 extends substantially in a longitudinal direction of the ski and is pivotal about a transversely extending bolt 10*b* (FIG. 4) secured to an extension 11*a* on a spring housing 11 and which is movably guided in slotted holes 3*e* in two platelike projections 3*f*, 3*g* (FIGS. 2, 3 and 4) of the housing portion 3*d* of the sole plate 3. A compression release spring 12 is housed in the spring housing 11. One end of the spring engages a piston 13, on the side thereof which is remote from the release spring 12 is supported a roller 14. The roller 14 is urged by the release spring 12 against a one-arm lever 15 which is pivotally supported in the housing 3*d* of the sole plate 3 on an axle. The lever has a cam or protuberance 15*a* on the side thereof remote from the roller 14. The cam rests on one side of a piston 16 movably guided in an opening 3*k* of the housing 3*d*. The side of the piston 16 opposite the cam engages the enlarged head of a mushroom-shaped follower member 2. In addition, a bolt or pin 16*a*, which extends in transverse direction, extends through the piston 16. The ends of the pin are guided in slotted holes 3*m* in the sidewalls of the housing 3*d* and project laterally beyond the sidewalls as shown in FIG. 5.

Approximately in the central region along the length of the spring housing 11, there transversely extends lateral bearing pins 11*b* which are connected to the spring housing, on which bearing pins are supported two two-arm levers 17. The lowermost ends of each lever 17 are connected to a bolt 17*a* rotatably supported thereon, which bolt has a threaded hole therein which extends transversely with respect to the axis of the bolt. An adjusting screw 18 is threadedly received into the threaded hole, which adjusting screw engages with its flange 18*a* the inner surface of the spring housing 11. A support wall 3*n* provided in the housing 3*d* of the sole plate 3 is engaged by the end of the other arm of each of the two-arm levers 17. The support wall 3*n* extends at least approximately parallel with respect to the upper surface of the ski.

Furthermore, an intermediate lever 19 which, viewed in the longitudinal direction of the ski, is approximately U-shaped, is pivotally supported for movement about the axle 15*b*, which lever 19 is urged clockwise (FIG. 4) under the influence of a torsion spring 19*a*. The intermediate lever 19 rests with one arm 19*c* on the bolt 16*a* of the piston 16. A further arm 19*d* of the intermediate lever 19 has an axle 19*b* thereon, which on the one hand extends through a slotted hole extending approximately in the longitudinal direction in the locking lever 10, and on the other hand serves as a bearing pin for a link member 20. The other end of the link member 20 is hingedly connected to one end of a release lever 21, which is constructed as a two-arm lever which is pivotally supported for movement about the axis of an axle 21*a* arranged on the housing 3*d* of the sole plate 3 or in the platelike projections 3*f*, 3*g* thereof.

The mushroom-shaped follower member 2, which is supported under the pressure of the piston 16 with its head on a pulled-in edge of the hole 3*k* in the housing 3*d* of the sole plate, has on its stem portion two axially spaced, approximately spherically enlarged regions 2*a* and 2*b*, of which the one spherical enlargement 2*a* is received in a horizontal guideway and the other spherical enlargement 2*b* is received in a vertical guideway, both guideways being provided on the bearing block 1*c*. The relationship between the release moment, which is necessary for effecting a release during a frontal fall and for effecting a release during a twisting fall is determined by this measure in adjustment with the corresponding moment arms of the sole plate.

If the ski binding is to be adjusted to the skiing ability and the physical characteristics of the skier, then first the adjusting screw 18 is turned, for example deeper into the threaded hole in the bolt 17*a*. This causes the lever 17 to be pivoted counterclock. wise and the spring housing 11 to be pivoted clockwise about the axis 10*b* relative to the sole plate due to the urging of the release spring 12 which, in this instance, becomes slightly relaxed. However, the roller 14, which is urged by the release spring 12 through the piston 13, moves at the same time along the side surface of the lever 15 in direction of the axle 15*b*. This causes, however, the effective lever arm of the lever 15 to be reduced in size and additionally the pressure which is applied on the piston 13 is reduced because of the slightly relaxed release spring 12.

Figure 1:
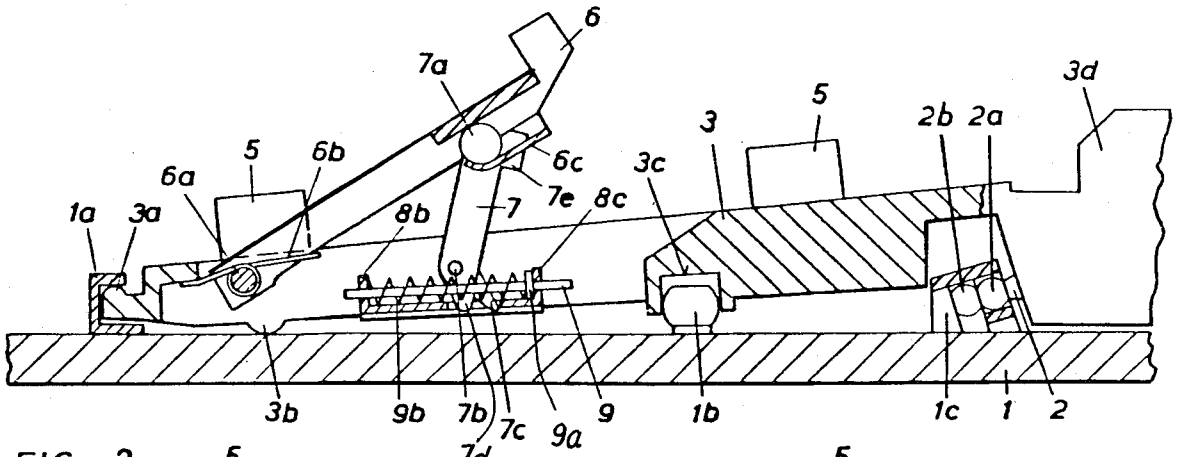
FIG. 1 is a cross-sectional view taken along the line I—I of FIG. 2.

During stepping in, the ski shoe 22 (same is only schematically indicated in FIG. 6) is positioned so that the cross surface of the heel is placed on the stepping bar 6 and is thereafter stepped or urged downwardly toward the sole plate 3 against the urging of the torsion spring 6*b*. The clamping jaws 5 are thereby opened due to the slide-member plate 8 being moved by the control lever 7, which is coupled with the stepping bar 6 through the roller 7*a*, first against the force of the release spring 12 generally to the left in FIG. 1. This is done by the outer prongs 7*d* of the control lever 7 engaging the two shoulders of the approximately T-shaped hole 8*d* and which cause the slide-member plate 8 to be moved toward the tip of the ski. The bolt 10*b* moves at the same time in the slotted holes 3*e* in the platelike projections 3*f* and 3*g* of the sole plate 3, which bolt, as explained above, forms the swivel axis for the locking lever 10. If, however, the outer prongs 7*d* of the control lever 7 have passed the upper boundary surface of the shoulder on the slide-member plate 8, then same moves quickly to the right under the influence of the release spring 12, whereby the wedge-shaped shoulders 8*a* of the slide-member plate 8 will rest on the corresponding sloped surfaces on the lower arms of the clamping jaws 5. In this manner, the ski shoe 22 becomes clamped in the ski binding. In this position the bolt 9 is supported on the nose 7*e* of the control lever 7.

If a fall occurs during skiing, then, independent from whether the fall is a frontal, a twisting or a combined fall, the follower member 2 is swung relative to the housing 3*d* on the sole plate 3 to cause the piston 16 to be moved back in the hole 3*k* against the force of the release spring 12 housed in the spring housing 11. The movement of the piston 16 and the bolt 16*a* thereon thereby effects a clockwise pivoting of the intermediate lever 19 and a lifting of the left end (FIG. 4) of the locking lever 10 due to the connection provided by the axle 19*b* and in this manner moves said locking lever 10 upwardly away from the rollers 8*g* which are supported on the slide-member plate 8. The slide-member plate 8 is now moved to the left in FIG. 1 due to the urging of the pressure spring 9*b*, which spring 9*b* was initially under tension on the flange 9*a* of the bolt 9 or through same on the nose, 7*e* of the control lever 7. The wedge-shaped shoulders 8*a* of the slide-member plate 8 are, however, through this removed from the corresponding surfaces on the lower arms of the clamping jaws 5, and the ski shoe 22 can leave the ski binding.

If the ski binding is to be voluntarily opened, a force is then applied to the release lever 21 with, for example, the tip of the ski pole, which force effects a clockwise swinging of the lever 21. However, this causes the locking levers 10 to be lifted due to their connection to the link members 20, which thence cause the rollers 8*g* to roll off from the shoulders 10*a* on the locking lever 10. The remaining operation corresponds to an automatic release of the ski binding.

Before the ski shoe 22 had left the ski binding, the slide-member plate was moved to the left by the pressure springs 9*b*, as was already discussed. This would permit the two outer prongs 7*d* of the control lever 7 to be able to again enter the hole 8*d* of the slide-member plate 8. The stepping bar 6, which is under the influence of the erecting spring 6*b* and is coupled with the control lever 7 through the roller 7*a*, thus reaches the position illustrated in FIG. 1. The slide-member plate 8 is thereby moved to the right by the inner prongs 7*c* of the control lever 7, which come to rest on the right boundary or edge of the hole 8*d*, until the rollers 8*g* will engage the shoulders 10*a* of the locking lever 10 as shown in FIG. 4. The stepping-in position of the ski binding is again created in this manner.

Of course, the invention is by no means to be limited to the exemplary embodiment which is illustrated in the drawings and which is described above. Rather, various modifications of the same are possible, without leaving the scope of the invention. For example, it would also be possible to equip the ski binding with a differently constructed follower member or with two follower members, which are arranged parallel to one another—one for frontal falls, the other for twisting falls.

The embodiments of the invention in which an exclusive property or privilege is claimed are defined as follows:

1. In a release ski binding comprising a sole plate pivotally supported on a ski in its central region about an approximately vertical axis and about a transverse axis arranged in front of said vertical axis, which in the skiing position is held on said ski by a holding mechanism which is biased by a release spring, said release spring responding to a swivelling movement of said sole plate relative to said ski upon reaching a predetermined angle of traverse to effect both upwardly and also to the side an opening of a locking mechanism, the improvement comprising wherein said locking mechanism includes:

two pairs of laterally spaced clamping jaws adapted to laterally engage a ski shoe, each clamping jaw being constructed as a two-arm lever;

pivot means for pivotally supporting each said clamping jaw on said sole plate and for movement between a ski shoe holding position and a ski shoe releasing position;

slide-member plate means movably guided on said sole plate and having wedge-shaped shoulder means thereon engagable with one arm of each of said clamping jaws to urge each said clamping jaw into said ski shoe holding position;

said release spring continually urging said slide-member plate means and said wedge-shaped shoulder means theren toward and into engagement with said one arm of each of said clamping jaws;

stepping bar means adapted to be stepped down upon by a ski shoe pivotally supported on said sole plate and movable between an upstanding position inclined to the upper surface of said sole plate and a generally horizontal position parallel to the upper surface of said sole plate; and control means responsive to the position of said stepping bar means for moving said slide-member plate means and said wedge-shaped shoulder means away from said one arm of each of said clamping jaws when said stepping bar means is inclined to the upper surface of said sole plate and against the resilient urging of said release spring and for effecting said slide-member plate means to move toward said one arm of each of said clamping jaws under the urging of said release spring when said stepping bar means is in said generally horizontal position.

2. The set binding according to claim 1, wherein said stepping bar means is pivotally supported for movement about an axis arranged in the region of the end of said sole plate closest to the tip of the ski.

3. The ski binding according to claim 1, wherein said control means includes a control lever constructed as a two-arm lever pivotally supported on said sole plate, one arm of said control lever being guided by means of a roller in guideway means provided on the underside of said stepping bar means.

4. The ski binding according to claim 3, wherein the other arm of said control lever is constructed fork-shaped and is provided with two inner prong means and two outer prong means.

5. The ski binding according to claim 4, wherein said slide-member plate means includes means on an upper side thereof defining two bearing blocks spaced from each other in a direction parallel to a longitudinal axis of said ski, an elongated bolt movably guided on said bearing blocks in a direction parallel to said longitudinal axis of said ski, and resilient means for resiliently urging said bolt to move toward the tail end of said ski when said stepping bar means in said generally horizontal position.

6. The ski binding according to claim 5, wherein said one arm of said control lever adjacent said roller has a nose member functioning as a bearing surface for said bolt when said stepping bar means is in said generally horizontal position and limiting the movement of said bolt toward the tail end of said ski.

7. The ski binding according to claim 5, wherein said slide-member plate means has, between said bearing blocks, a T-shaped hole, into which hole said inner and said outer prong means of said control lever are received when said stepping bar means is in said upstanding position.

8. The ski binding according to claim 1, wherein said slide-member plate means is releasably connected through at least one one-arm locking lever to said resiliently biased holding mechanism, said holding mechanism being housed in a housing on said sole plate.

9. The ski binding according to claim 8, wherein said holding mechanism includes a locking lever having a shoulder thereon extending transversely with respect to the longitudinal axis of said ski, and wherein said slide-member plate means includes a fork-shaped end on its end adjacent said holding mechanism, and a roller mounted on each leg of said fork shaped end, which roller, in said ski shoe holding position, rests on said shoulder.

10. The ski binding according to claim 8, wherein said holding mechanism has a mushroom-shaped follower member, which with its enlarged head is swingably supported to all sides in a hole in a shoulder on said sole plate, is held in the normal position under the influence of a piston which is biased by said release spring and the stem portion thereof is received into a ski-fixed fitting, wherein a bolt extends through said piston, the ends of which are guided in slotted holes in said housing and on the ends of which, which ends project laterally beyond said slotted holes, there rest under the influence of a torsion spring the legs of an intermediate lever which is pivotally supported on said housing of said sole plate and which is approximately U-shaped, which intermediate lever is coupled to said locking lever.

11. The ski binding according to claim 10, wherein for coupling of said intermediate lever with said locking lever, one arm of said intermediate lever has an axle thereon which is guided in a slotted hole which extends in the longitudinal direction of the locking lever.

12. The ski binding according to claim 11, wherein at least one link member is at one end thereof arranged on said axle, the other end of said link member being hingedly connected to a release lever which is supported in said housing of said sole plate and is constructed as a two-arm lever.

13. The ski binding according to claim 10, wherein said holding mechanism further includes a one-arm lever having a cam surface on one side thereof supported on an axle pivotally supporting said intermediate lever, said cam surface engaging one side of said piston, the opposite side of said one-arm lever being loaded by said release spring of said holding mechanism.

14. The ski binding according to claim 13, wherein said locking lever is pivotally supported on a pivot axle movable longitudinally of said ski in a slotted hole in a spring housing, and wherein said release spring is housed in said spring housing, said spring housing being pivotal about said pivot axle.

15. The ski binding according to claim 14, wherein in the center area of said spring housing bearing laterally extending pins are attached to said housing and on which two-arm levers are supported, one end of each two-arm lever being connected to a rotatably supported bolt and the other ends of which are supported on a support wall in said housing, said support wall extending at least approximately parallel with respect to the upper surface of said ski.

16. The ski binding according to claim 15, wherein said bolt has a threaded hole therein which extends transversely with respect to the axis of the bolt, in which threaded hole is threadedly received an adjusting screw the end of which is supported on the inner side of said spring housing.

17. The ski binding according to claim 14, wherein a piston which is biased by said release spring is guided in said spring housing, which piston carries a roller on its side remote from said release spring, which roller engages said opposite side of said one-arm lever.

18. The ski binding according to claim 1, wherein said slide-member plate means includes two vertically spaced plate-shaped parts receiving therebetween said wedge-shaped shoulder, said parts being connected to one another by a rivet means.

* * * * *